United States Patent [19]

Ohtake et al.

[11] Patent Number: 4,631,925

[45] Date of Patent: Dec. 30, 1986

[54] APPARATUS FOR DEAERATING CONDENSATE IN A CONDENSER

[75] Inventors: Katsumoto Ohtake; Yoshikuni Ohshima; Yasuteru Mukai; Isao Okouchi, all of Hitachi, Japan

[73] Assignee: Hitachi, Ltd., Tokyo, Japan

[21] Appl. No.: 701,164

[22] Filed: Feb. 13, 1985

[30] Foreign Application Priority Data

Feb. 14, 1984 [JP] Japan ..... 59-24392

[51] Int. Cl.[4] ..... F01K 9/00

[52] U.S. Cl. ..... 60/688; 60/692

[58] Field of Search ..... 60/646, 657, 690, 692, 60/688

[56] References Cited

U.S. PATENT DOCUMENTS 4,353,213 10/1982 Masuda et al. ..... 60/692 X 4,434,620 3/1984 Ishimaru et al. ..... 60/692 X

*Primary Examiner*—Allen M. Ostrager

*Attorney, Agent, or Firm*—Antonelli, Terry & Wands

[57] ABSTRACT

An apparatus for deaerating condensate in a condenser employed in a steam turbine plant, an open conduit to permit the condensate to flow to a covered conduit covered so that the condensate cannot flow therein without passing the open conduit. The condensate is heated in the open conduit, resulting in more effective and quicker deaeration of the condensate and as well as a shortened start up of the plant.

9 Claims, 5 Drawing Figures

APPARATUS FOR DEAERATING CONDENSATE IN A CONDENSER

BACKGROUND OF THE INVENTION

This invention relates to an apparatus for deaerating condensate in a condenser, and, more particularly, a condenser for a steam turbine plant whose start up is shortened.

In a steam turbine plant, it is necessary to deaerate the condensate before it is fed as the feedwater to the boiler in order to prevent the boiler from being corroded by the gases, particularly oxygen, dissolved in the condensate. The oxygen concentration of the condensate in the condenser is about 8000 ppb when the plant is not operating. On the other hand in order to prevent the corrosion of the boiler, it is necessary that the oxygen concentration of the feedwater is less than around 8 ppb. In general, the condensate from the condenser is recycled to the condenser, while the inside of the condenser is depressurized to a vacuum by an air ejector in order to deaerate the condenser. With only this measure, however, it is difficult to make the quick start up of the plant possible.

In, for example, Japanese Laid Open Patent Publication, No. 78/72903, it is known that oxygen dissolved in the condensate is partially removed by heating the condensate before the condensate reaches a hotwell of the condenser. That is, after only part of the condensate is heated by heat pipes disposed in a container, thus heated condensate overflows from the container whose lower part has no opening. Additionally some part of the condensate flows or is directly supplied to the hotwell even without being led to the container. Accordingly, it still takes a long time to deaerate the condensate.

An object of the invention is to provide an apparatus for quickly deaerating the condensate in a condenser.

This object is achieved by providing within a hotwell of the condenser an open conduit to permit the condensate to flow to a covered conduit covered so that the condensate cannot flow therein without passing the open conduit, and by heating the condensate in the open conduit.

According to this invention, more oxygen can be dissolved from the condensate and be removed into a condensing part of the condenser without dissolved oxygen being transferred into the covered conduit together with the condensate. Additionally the whole condensate is heated, resulting in more efficient deaeration of the condensate.

DETAILED DESCRIPTION

Figure 1:
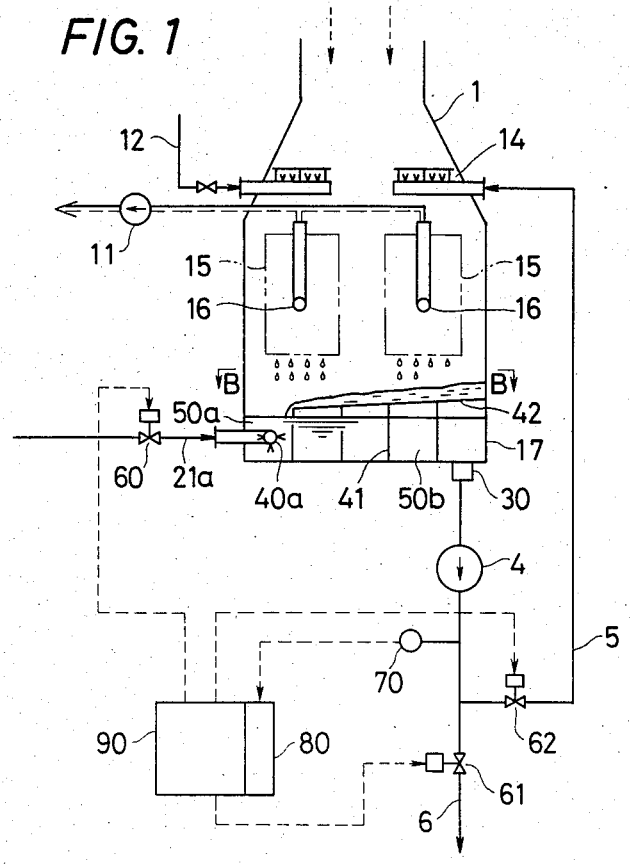
FIG. 1 is a schematic view of a condensate deaeration apparatus according to one embodiment of the present invention.
Figure 2:
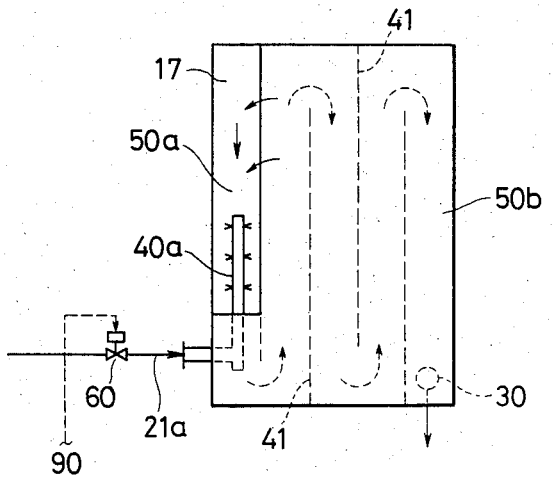
FIG. 2 is a cross sectional view taken along line B—B of FIG. 1.

Referring now to the drawings wherein like reference numerals are used throughout the various views to designate like parts and, more particularly, to FIGS. 1 and 2, according to these figures, a steam expanded through a steam turbine (not shown) is led to a condenser 1 as shown by dotted lines, with the condenser mainly comprising a condensing part to condense the steam and a hotwell 17 to store the condensate produced by the condensing part which includes tube bundle 15 to cool the steam. Air including oxygen dissolved from the condensate can be extracted by an air ejector 11 through an air extraction pipe 16.

The hotwell has an open conduit 50*a* adjacent to the inside wall of the hotwell to permit the condensate to flow a covered conduit 50*b* covered by a cover plate 42. Accordingly, the condensate flows on the cover plate 42 towards the open conduit 50*a*. The cover plate is inclined so that the condensate can easily flow towards the open conduit 50*a*.

The condensate in the open conduit 50*a* is heated by steam coming out of a steam pipe 40*a*. Instead of the steam pipe this may be replaced by a heat pipe. The steam is adjusted by a heating valve 60 attached to a pipe 21*a*. This heating enables a greater deaeration of the condensate. The dissolved oxygen can be moved through the air extracting pipe 16. After the whole condensate is treated in this manner, it flows to the covered conduit 50*b* which is constructed to have a narrow long path by baffle plates 41 as shown in FIG. 2. "Covered conduit" means "substantially covered conduit" so this wording does not omit a cover plate with holes.

A condensate pipe 6 is connected to an outlet of the hotwell 30, with a condensate pump 4 and a condensate valve 61 being attached to this pipe 6. The condensate can be fed to auxiliary devices such as, for example, a boiler, through the pipe 6. A recirculating pipe 5 is branched off from the pipe 6 between the pump 4 and the valve 61 and connected to a sprayer 14 through a recirculating valve 62. The condensate, through the pipe 5, is sprayed into the condensing part of the condenser 1 by the sprayer 14.

The concentration of oxygen dissolved in the condensate existing in the pipe 6 can be measured by a sensor 70 and a measured signal is supplied to a monitor 80 and at the same time delivered to a controller 90 through the monitor 80. Before the plant starts up, in other words when the measured oxygen concentration is more than a predetermined value, the controller 90 outputs signals to open the valve 60 and the valve 62 and to close the valve 61; whereas, when the concentration is less than the predetermined value, reverse signals are outputted and make the plant start up by feeding the condensate to the auxiliary devices. While the condensate is fed to a boiler, necessary auxiliary water can be introduced through a pipe 12.

Figure 3:
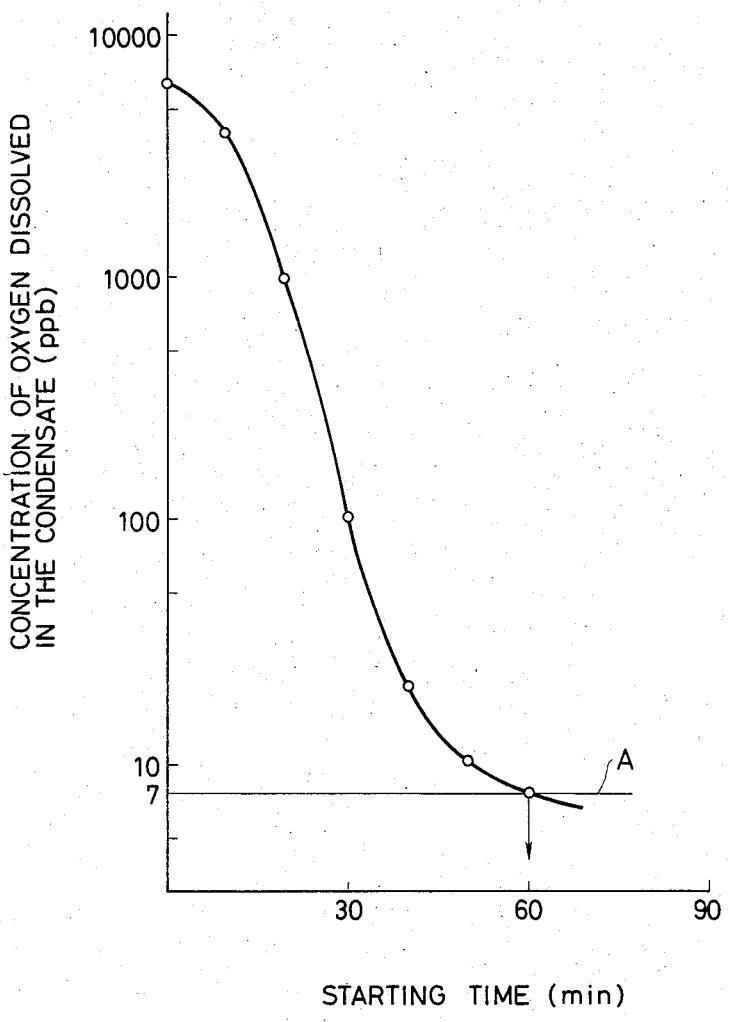
FIG. 3 is a graphical illustration of a relationship between oxygen concentration of the condensate and deaeration time.

FIG. 3 shows the concentration of oxygen dissolved in the condensate can decrease rapidly, which enables short starting time and quick start up on the plant according to this invention.

Figure 4:
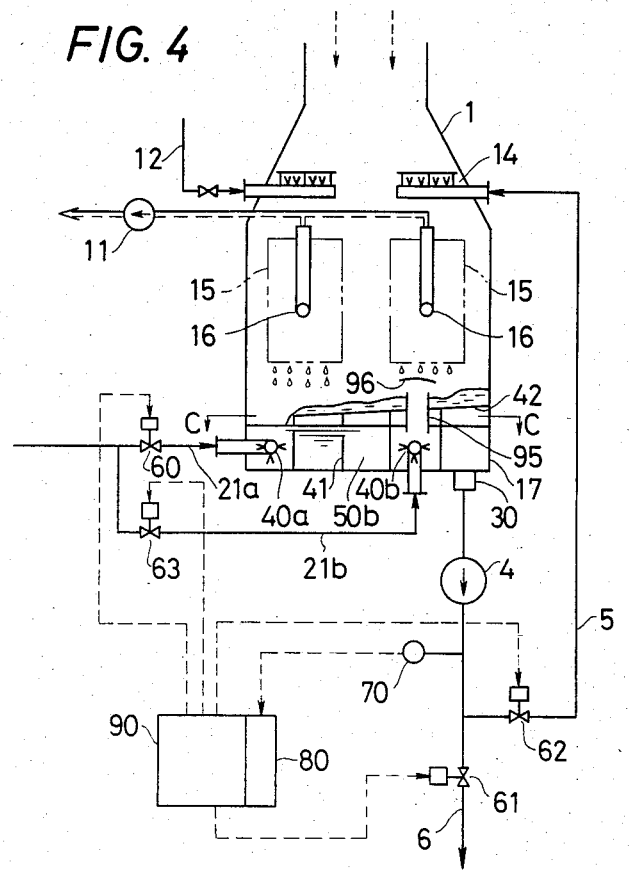
FIG. 4 is a diagram of a condensate deaeration apparatus according to another embodiment of the present invention.
Figure 5:
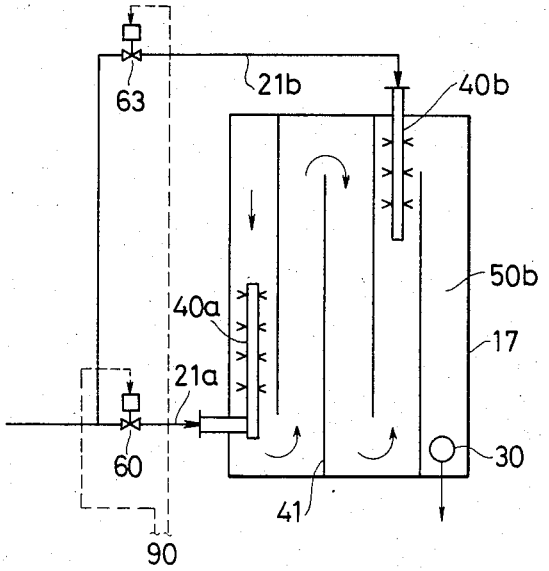
FIG. 5 is a cross sectional view taken along line C—C of FIG. 4.

The embodiment of FIGS. 4 and 5 differs from the above-described embodiment in that another heating means 40*b* is disposed in the covered conduit and its resulting dissolved oxygen can be delivered into the condensing part of the condenser through an outlet 95 over which a cover 96 is disposed. Furthermore, a heating valve 63, for adjusting the heating means 40*b* is connected to the heating pipe 21*b*. According to the embodiment of FIGS. 4, 5, oxygen left dissolved in the condensate can be further deaerated.

What is claimed is:

1. An apparatus for deaerating condensate in a condenser including condensing means for producing condensate by condensing steam expanded through a steam turbine and a hot well for storing the condensate, the apparatus further including means for extracting air from the condensing means, an open conduit, constructed in the hotwell, for permitting said condensate to flow to a covered conduit, said covered conduit constructed in the hotwell and covered so that said condensate cannot flow therein without passing through the open conduit, heating means for heating the condensate in said open conduit, recirculating means for recirculating the condensate from the hotwell into said condensing means, and means for spraying the recirculated condensate at the condensing means.

2. The apparatus according to claim 1, wherein said heating means includes means for blowing steam into said open conduit.

3. The apparatus according to claim 1, wherein said heating means includes heat pipes disposed in said open conduit.

4. The apparatus according to claim 1, wherein said covered conduit includes a cover plate inclined towards said open conduit so that the condensate easily flows thereon towards said open conduit.

5. The apparatus according to claim 1, wherein a plurality of baffle plates are provided in said covered conduit.

6. The apparatus according to claim 5, wherein another heating means is provided in said covered conduit, and means for leading gas dissolved from the condensate to said condensing means.

7. The apparatus according to claim 5, wherein said open conduit is disposed adjacent to an inside wall of the hot-well.

8. The apparatus according to claim 1, further comprising a condensate pipe means, connected to an outlet of said covered conduit, for feeding said condensate to a boiler, a condensate pump, a condensate valve disposed downstream of the condensate pump, a recirculating pipe, branched off from the condensate pipe means between the condensate pump and the condensate valve, for recirculating the condensate into said condensing means, a recirculating valve connected to the recirculating pipe, heating valve connected to said heating means, a sensor means for measuring the concentration of oxygen dissolved in the condensate and control means for controlling the condensate valve, the recirculating valve and the heating valve on the basis of the oxygen concentration measured by said sensor means.

9. The apparatus according to claim 8, wherein said control means adjust so that when the condensate valve is closed, the recirculating valve and the heating valve are open while the measured oxygen concentration is more than a predetermined value.

* * * * *